US005210457A

United States Patent [19]

Oshima et al.

[11] Patent Number: 5,210,457

[45] Date of Patent: May 11, 1993

[54] OUTER ELECTRODE FOR SPARK PLUG AND A METHOD OF MANUFACTURING THEREOF

[75] Inventors: Takafumi Oshima; Minoru Ando, both of Nagoya, Japan

[73] Assignee: NGK Spark Plug Co., Ltd., Nagoya, Japan

[21] Appl. No.: 714,270

[22] Filed: Jun. 12, 1991

[30] Foreign Application Priority Data

Sep. 7, 1990 [JP] Japan ..... 2-238224
Sep. 7, 1990 [JP] Japan ..... 2-238225

[51] Int. Cl.[5] ..... H01T 13/32; H01T 21/02

[52] U.S. Cl. ..... 313/11.5; 313/141; 313/142; 445/7

[58] Field of Search ..... 313/141, 11.5, 142; 445/7

[56] References Cited

U.S. PATENT DOCUMENTS 4,931,686 6/1990 Oakley ..... 313/141

FOREIGN PATENT DOCUMENTS 295085 12/1990 Japan ..... 313/141

*Primary Examiner*—Palmer C. DeMeo
*Attorney, Agent, or Firm*—Cooper & Dunham

[57] ABSTRACT

In an outer electrode, a rear end of which is securely connected to a metallic shell of a spark plug by means of welding to form a spark gap between a front end of the outer electrode and a firing tip of a center electrode which is concentrically placed within the metallic shell through an insulator, a middle core which is provided which is made of copper, and the middle core is clad by a heat and spark-erosion resistant metal. A centermost core is clad by the middle core. The centermost core is made of a similar metal to the metallic shell, and rear end of the centermost core is welded to the metallic shell so as to reinforce a welding portion between the metallic shell and the outer electrode.

7 Claims, 10 Drawing Sheets

114
113
109
110

115
116

116a
116
5

OUTER ELECTRODE FOR SPARK PLUG AND A METHOD OF MANUFACTURING THEREOF

BACKGROUND OF THE INVENTION

1. Field of the Invention

This invention relates to an outer electrode for a spark plug and a method of manufacturing thereof which includes a center electrode placed within a metallic shell through an insulator with the outer electrode located to oppose to the center electrode through a spark gap, and particularly concerns to an outer electrode for a spark plug and a method of manufacturing thereof in which a rear end of the outer electrode is securely connected to a front end of the metallic shell by means of welding.

2. Description of the Prior Art

In an outer electrode for use in a spark plug which is usually employed to an internal combustion engine, the outer electrode has one end securely welded to a metallic shell which includes a center electrode placed within the metallic shell through an insulator with the outer electrode physically bent to oppose to the center electrode through a spark gap.

The outer electrode, thus welded to the metallic shell, has generally been made of nickel-based alloy by adding Si Cr, Al and Mn to 95% or more nickel which has a heat-dissipating (heat-conductive) property in addition to a heat and spark-erosion resistant property.

With a recent high-output engine, however, it has been desired to introduce an outer electrode especially superior in heat-dissipating (heat-conductive) property.

In order to cope with the recent desire, it is suggested that the outer electrode is made of a copper core which has a good heat-dissipating (heat-conductive) property. Due to relatively weak strength of a welding portion between the outer electrode and the metallic shell, cracks often occur on the welding portion when the outer electrode is physically bent to substantially form a L-shaped configuration.

With the welding portion carrying cracks, it is supposed that the core made of copper comes to lose its good heat-dissipating property so as to result in a limitted extension period of service life when mounted on an internal combustion engine.

Therefore, it is an object of the invention to provide an outer electrode for a spark plug which is capable of maintaining a good heat-dissipating property, and at the same time, obtaining a strong adhesion between an outer electrode and a metallic shell so as to insure an extended period of service life.

SUMMARY OF THE INVENTION

According to the invention, in an outer electrode, a rear end of which is securely connected to a metallic shell of a spark plug by means of welding to form a spark gap between a front end of the outer electrode and a firing tip of a center electrode which is concentrically placed within the metallic shell through an insulator, the outer electrode comprising: a middle core which is made of copper to have a heat-conductive property, and the middle core being clad by a heat and spark-erosion resistant metal; and a centermost core clad by the middle core, the centermost core being made of a welding intense metal to the metallic shell, and rear end of the centermost core being welded to the metallic shell so as to reinforce a welding portion between the metallic shell and the outer electrode.

The centermost core is directly welded to the metallic shell so that securement between the outer electrode and the metallic shell is strengthened.

The centermost core terminates its front end short of that of the middle core so as to maintain a heat-dissipating property.

Further, the centermost core has a thermal expansion substantially similar to that of the metal cladding the middle core, and at the same time, having an axial length similar to that of the middle core. This structure enables to alleviate thermal stresses among the centermost core, the middle core and the metal cladding the middle core, and thus maintaining a predetermined spark gap between the electrodes.

Moreover, a method of manufacturing an outer electrode comprising steps of; forcing the centermost core into an upper recess provided with a metallic column made of copper to form a first body, an upper end of the column having a flange portion to serve as a stopper; forcing the first body into a cup-shaped metal until the flange portion reaches to an upper end of the cup-shaped metal to form a second body; forcing the second body into a circular hole provided with a die to extrude the second body so as to form an elongated bar; removing the flange portion from the elongated bar; forcing the elongated bar into a rectangular hole provided with a rectangular die to extrude the elongated bar so as to form a rectangular bar; cutting a rear portion of the rectangular bar so that a rear end of the rectangular bar is flush with that of the metall cladding the middle core; and thermally anealing the rectangular bar.

These and other objects and advantages of the invention will be apparent upon reference to the following specification, attendant claims and drawings.

DETAILED DESCRIPTION OF THE EMBODIMENTS

Figure 1:
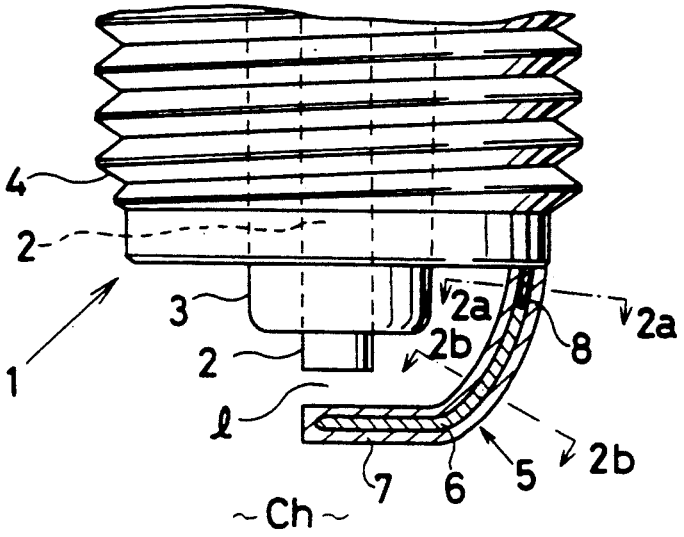
FIG. 1 is a longitudinal cross sectional view of an outer electrode showing with a spark plug according to a first embodiment of the invention, but the spark plug is partly shown.

Referring to FIG. 1 which shows a first embodiment of the invention, numeral 1 designates a spark plug which has a center electrode 2 concentrically placed within a cylindrical metallic shell 4 through a tubular insulator 3. The center electrode 2 is a composite metal consisting of a copper core clad by a nickel-based alloy, and connected to a high tension cord (not shown). The insulator 3 is made of ceramic material with an alumina as a main component, and fixedly securing the center electrode 2 in position. The metallic shell 4 is made of ferro-based metal, an outer surface of which has a male thread 4*a* for a convenience when mounted on an engine block of an internal combustion engine (not shown).

On the other hand, an outer electrode 5 is in the form of an elongation, a rear end of which is securely connected to a front end of the metallic shell 4 by means of welding, a front portion of the outer electrode 5 is physically bent to generally form a L-shaped configuration so as to oppose to a firing tip 2*a* of the center electrode 2 through a spark gap (1). The outer electrode 5 has a middle core 6 made of copper to provide a heat-dissipating (heat-conductive) property, and clad by an outer metal 7 which is made of pure nickel (Ni), nickel-based alloy or Inconel (alloy of Ni and Cr and Fe) each welding intense to the metallic shell 4, and at the same time, superior in a heat and erosion-resistant property. A centermost core 8 is clad by the middle core 6, and made of pure nickel, nickel-based alloy or pure iron each welding intense to the metallic shell 4 since the outer metal 7 is generally exposed to a combustion chamber (Ch), and a spark discharge at once. The centermost core 8 terminates its rear end at that of the middle core 6 and the outer metal 7 to be flush therewith, while the centermost core 8 terminates its front end considerably short of that of the middle core 6. By way of example, the axial length of the centermost core 8 is determined to be 1/5 of that of the outer electrode 5 which approximately measures e.g. 15 mm in length.

Figure 2A:
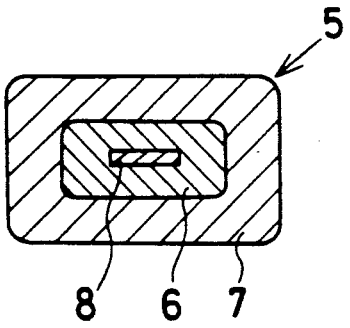
FIG. 2*a* is a latitudinal cross sectional view taken along the line 2*a*—2*a* of FIG. 1.
Figure 2B:
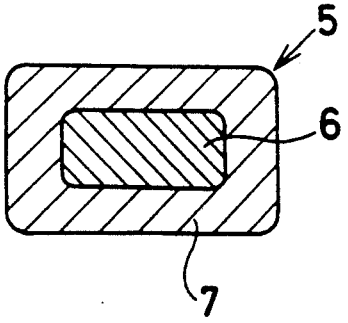
FIG. 2*b* is a latitudinal cross sectional view taken along the line 2*b*—2*b* of FIG. 1.

In this instance, each rear end of the centermost core 8 and the outer metal 7 is directly welded to the front end of the metallic shell 4 when the rear end of the outer electrode 5 is securely connected to the metallic shell 4 by means of welding. A cross sectional area of the centermost core 8 is predetermined to be 60% or more of that of the middle core 6 as shown in FIG. 2*a*, while a cross sectional area of the middle core 6 predetermined to be 40% or less of that of the outer electrode 5 as shown in FIG. 2*b*.

Figure 4:
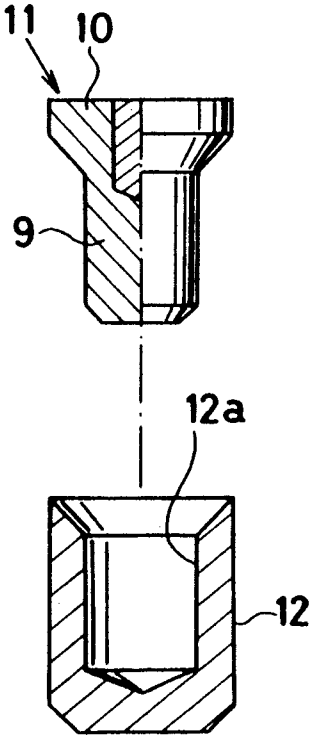
Figure 3:
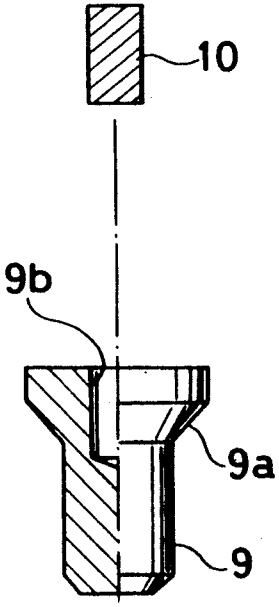

Referring to FIGS. 3 though 9, the outer electrode 5 is manufactured as follows:

(i) As shown in FIG. 3, a nickel elongation strip 10, which serves as the centermost core 8, is prepared to have an axial length considerably shorter than that of a copper column 9. The column 9 has prepared to carry an upper end having a flange portion 9*a* to work as a stopper. Then, the elongation strip 10 is forced into an upper recess 9*b* provided with the copper column 9 to form a first body 11 as shown in FIG. 4. The column 9 carries an upper end having a flange portion 9*a* to work as a stopper.

Figure 5:
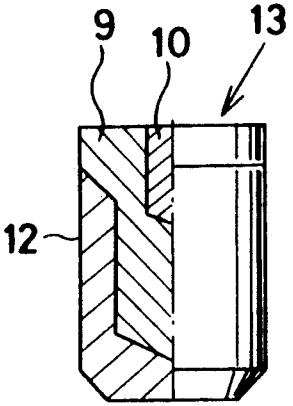

(ii) The first body 11 is forced into a hollow 12*a* of a cup-shaped nickel alloy 12 until the flange portion 9*a* reaches to an upper end of the cup-shaped nickel alloy 12 to form a second body 13 as shown in FIG. 5.

Figure 6:
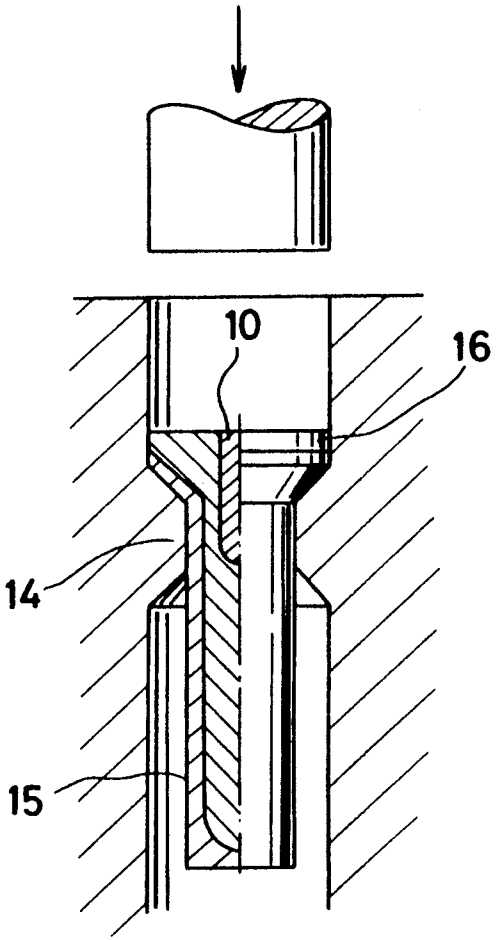
FIGS. 3 through 9 are each schematic views of manufacturing processes of the outer electrode according to a first embodiment of the invention.

(iii) The second body 13 is forced into a circular hole provided with a circular die 14 to extrude the second body so as to form an elongated bar 15 circular in section as shown in FIG. 6.

Figure 7:
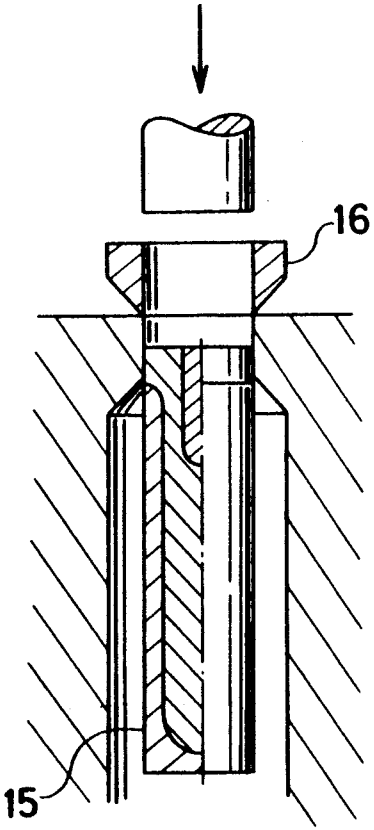

(iv) A flange head 16 which is provided with the elongated bar 15 is removed from the elongated bar 15 as shown in FIG. 7.

Figure 8:
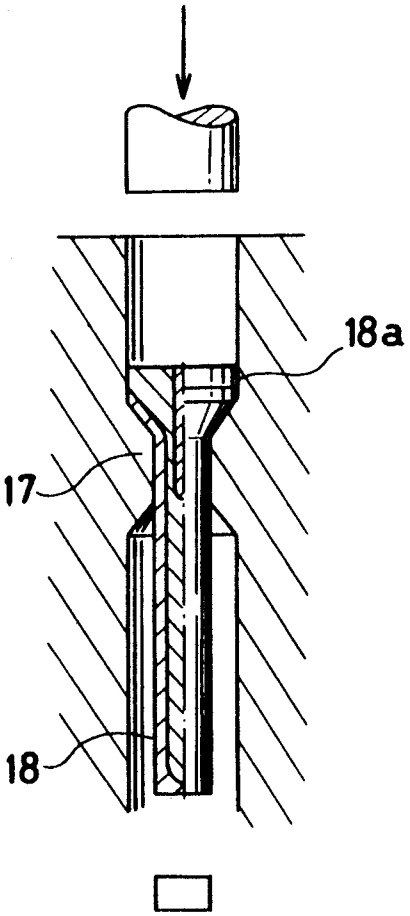

(v) The elongated bar 15 is forced into a rectangular hole provided with a rectangular die 17 to extrude the elongated bar 15 so as to form a rectangular bar 18 rectangular in section as shown in FIG. 8.

Figure 9:
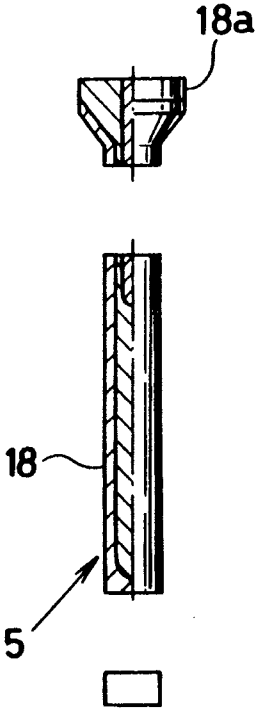

(vi) Then, a rear portion 18*a* of the rectangular bar 18 is cut so that a rear end of the centermost core 8 is flush with that of the outer metal 7 and the middle core 6; and the rectangular bar 18 is thermally anealed to form the outer electrode 5 as shown in FIG. 9.

Figure 10:
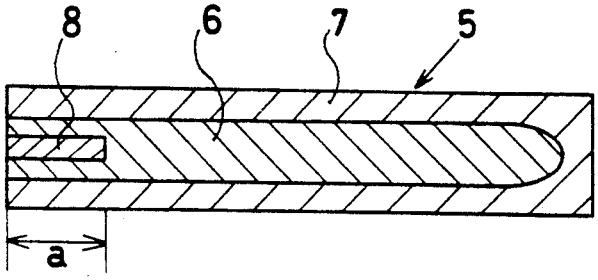
FIG. 10 is a longitudinal cross sectional view, but enlarged more than FIG. 1.
Figure 11:
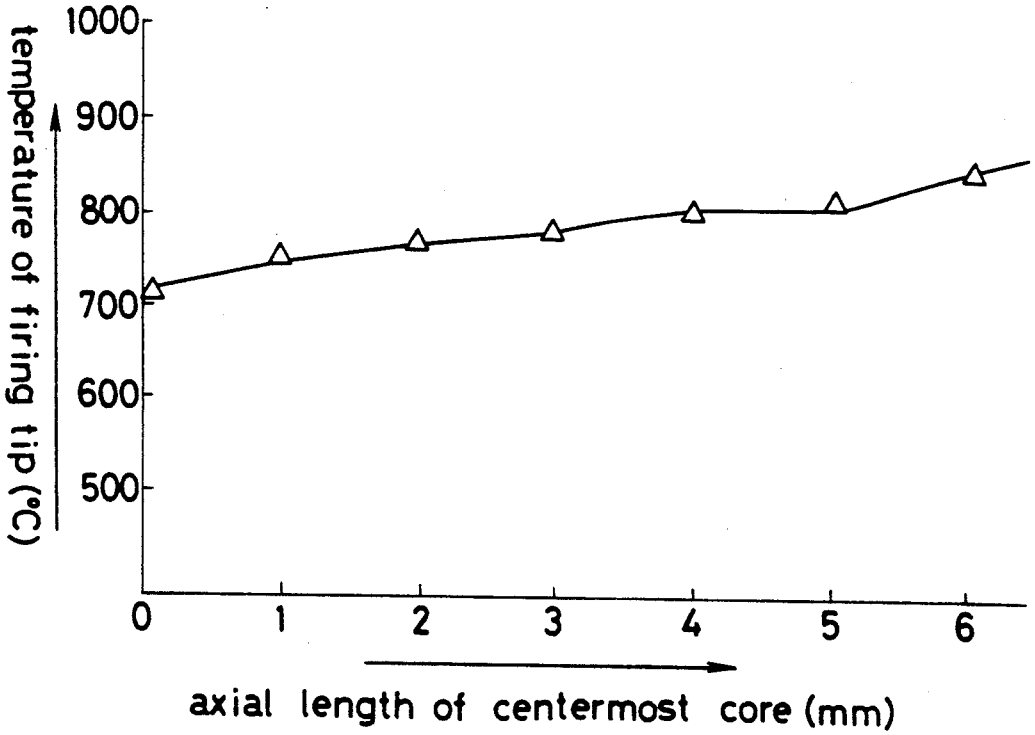
FIG. 11 is a graph showing a relationship between axial length of a centermost core and temperature of a firing tip of a center electrode.

With the outer electrode 5 shown in FIG. 10 employed, a first experiment is carried out to find how an axial length (a) of the centermost core 8 has an influence on a heat-dissipating (heat-conductive) effect of the outer electrode 5 shown in FIG. 2*a*. The result obtained after the first experiment is as shown in FIG. 11 which indicates that the heat-dissipating is improved with the decrease of the axial length (a) of the centermost core 8.

Figure 12:
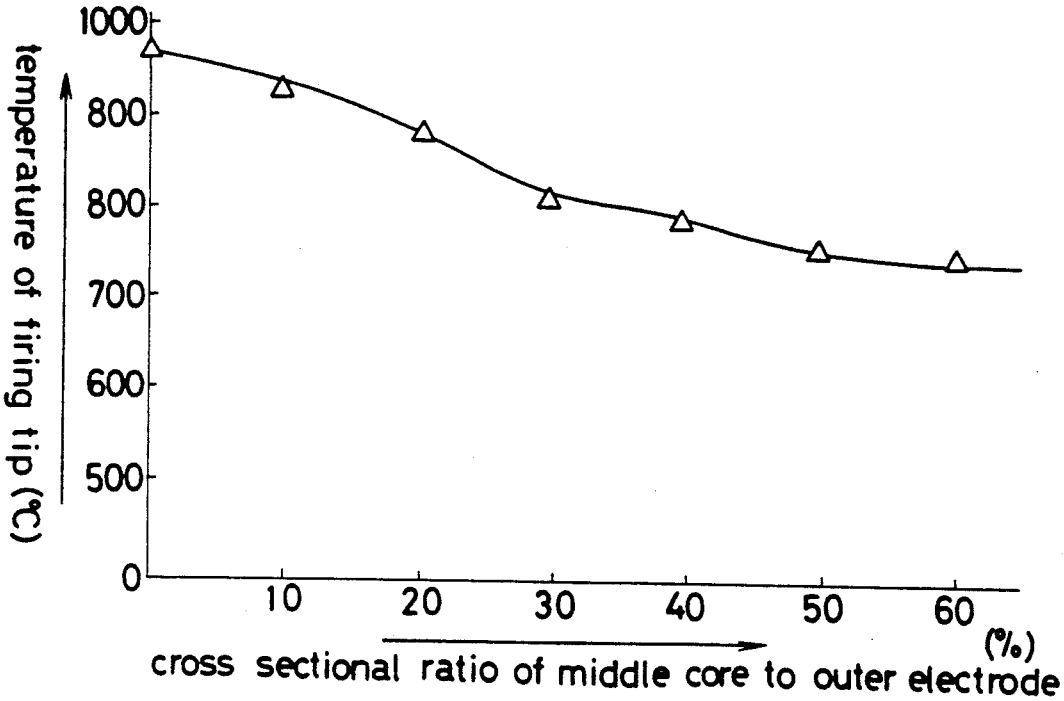
FIG. 12 is a graph showing a relationship between temperature of the firing tip of the center electrode and cross sectional ratio of the middle core to the outer electrode.

A second experiment is carried out to find how a cross sectional ratio of the middle core 6 to the outer electrode 5 has an influence on a heat-dissipating effect of the outer electrode 5 shown in FIG. 2*b*. The result obtained after the second experiment is as shown in FIG. 12 which indicates that the sufficient heat-dissipating is insured by determining the cross sectional ratio to be 20% or more.

Figure 13:
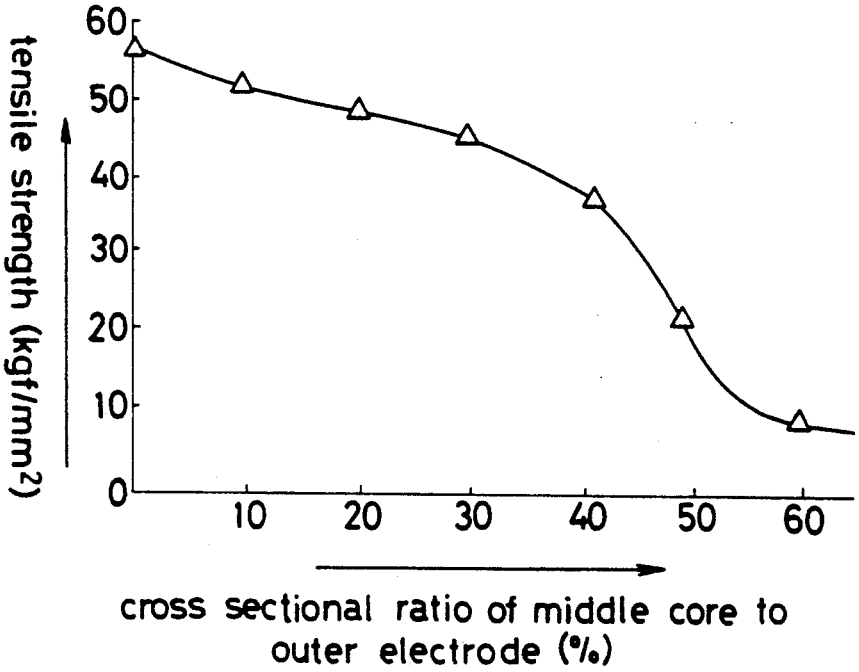
FIG. 13 is a graph showing a relationship between tensile strength and cross sectional ratio of the middle core to the outer electrode.

With a cross section of the centermost core 8 constant, a third experiment is carried out to find how a cross sectional ratio of the middle core 6 to the outer electrode 5 has an influence on a tensile strength of the welding portion between the metallic shell 4 and the outer electrode 5. The result obtained after the third experiment is as shown in FIG. 13 which indicates that the sufficient tensile strength is insured by determining the cross sectional ratio to be 40% or less.

As apparent from the three experiments, the centermost core 8 which terminates short of the front end of the middle core 6 makes it possible to significantly insure the heat-dissipating effect of the outer electrode 5.

The outer electrode 5 is physically strongly connected to the metallic shell 4 by welding the outer metal 7 and the centermost core 8 to the metallic shell 4 at once.

Further, the outer electrode 5 has manufacturing processes partly common to those of the center electrode 2, and thus contributing to reducing the manufacturing cost.

Figure 14:
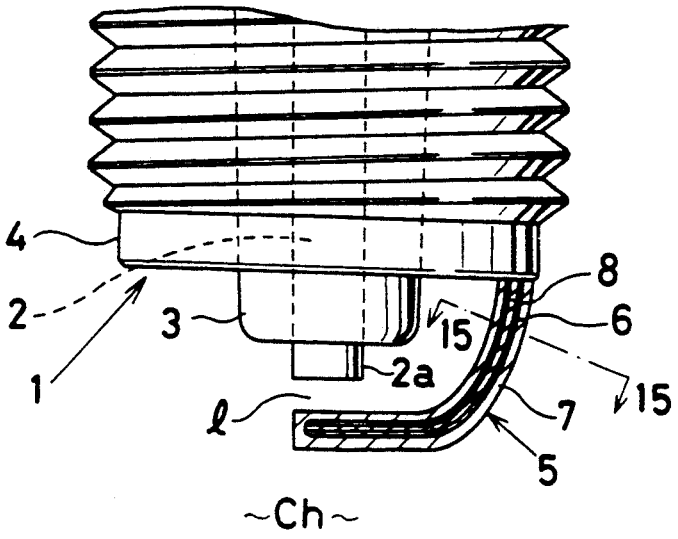
FIG. 14 is a view similar to FIG. 1 according to a second embodiment of the invention.
Figure 15:
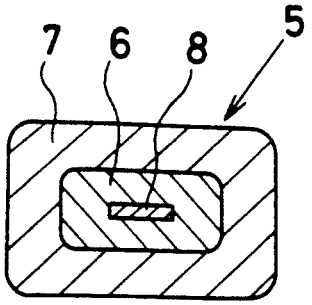
FIG. 15 is a latitudinal cross sectional view taken along the line 15—15 of FIG. 14.

Referring to FIGS. 14 and 15 which shows a second embodiment of the invention, like reference numerals in FIGS. 14 and 15 are identical to those in FIGS. 1, 2*a* and 2*b* of the first embodiment of the invention. In the first embodiment of the invention, the centermost core 8 has a coefficient of thermal expansion similar to that of the outer metal 7, while the centermost core 8 has an axial length similar to that of the middle core 6. This structure enables to alleviate thermal stresses among the centermost core 8, the middle core 6 and the outer metal 7 to substantially prevent the outer electrode 5 from being unfavorably deformed, and thus maintaining the spark gap (1) as predetermined.

In this instance, a cross sectional area of the middle core 6 is determined to fall within a range from 20% to 50% of that of the outer electrode 5.

Figure 16:
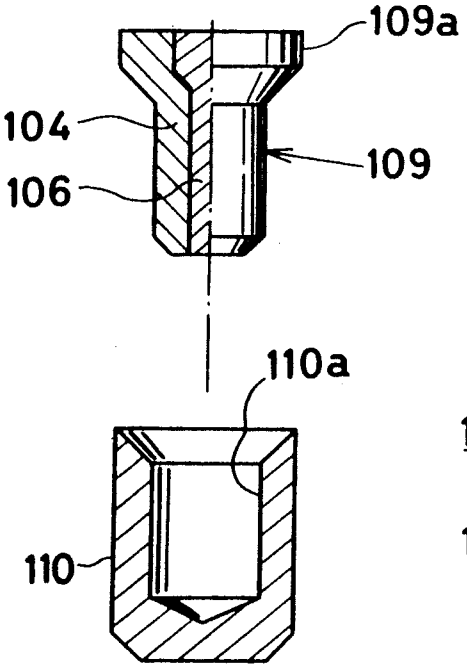

The outer electrode 5, thus structured according to the second embodiment of the invention, is manufactured as follows:

(i) A nickel extension strip 106 which serves as the centermost core 8 is prepared, an axial length of which is substantially the same as a copper tube 104. Into the copper tube 104, which has an outer flange portion 109*a* to serve as a stopper, is the nickel extension strip 106 forced to form a clad wire 109 as shown in FIG. 16.

Figure 17:
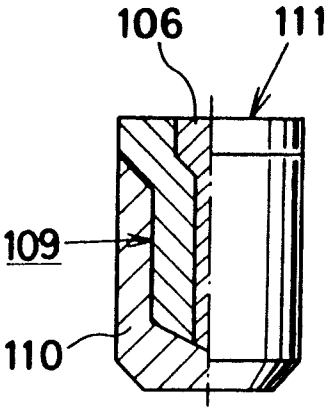

(ii) The clad wire 109 is forced into a hollow portion 110*a* of a cup-shaped nickel alloy 110 until the outer flange portion 109*a* reaches to an upper end of the cup-shaped nickel alloy 110 to form a composite body 111 as shown in FIG. 17.

Figure 18:
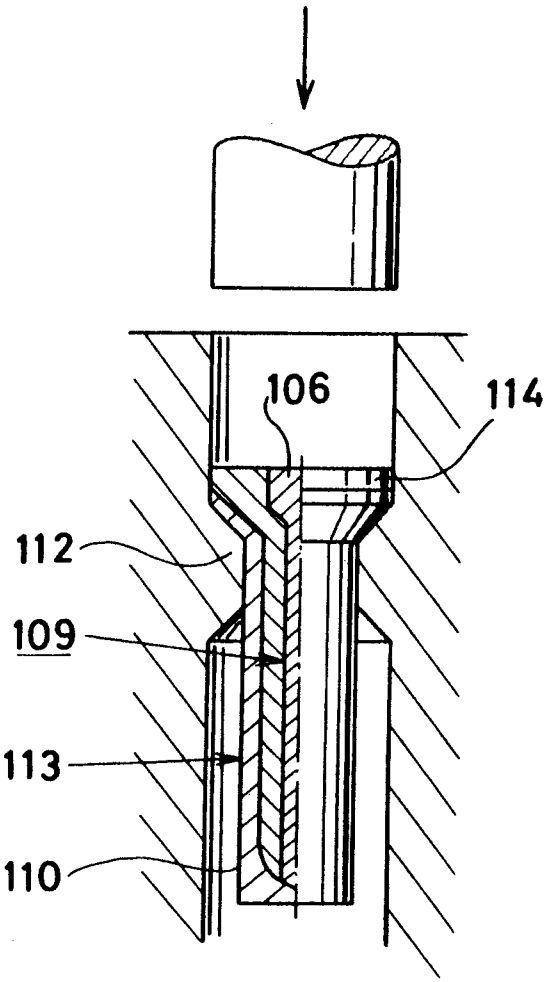
FIGS. 16 through 21 are views integrally similar to FIGS. 3 through 9 according to the second embodiment of the invention.

(iii) The composite body 111 is forced into a circular hole provided with a circular die 112 to extrude the composite body 111 so as to form an elongated bar 113 circular in section as shown in FIG. 18.

Figures 19, 20, 21:
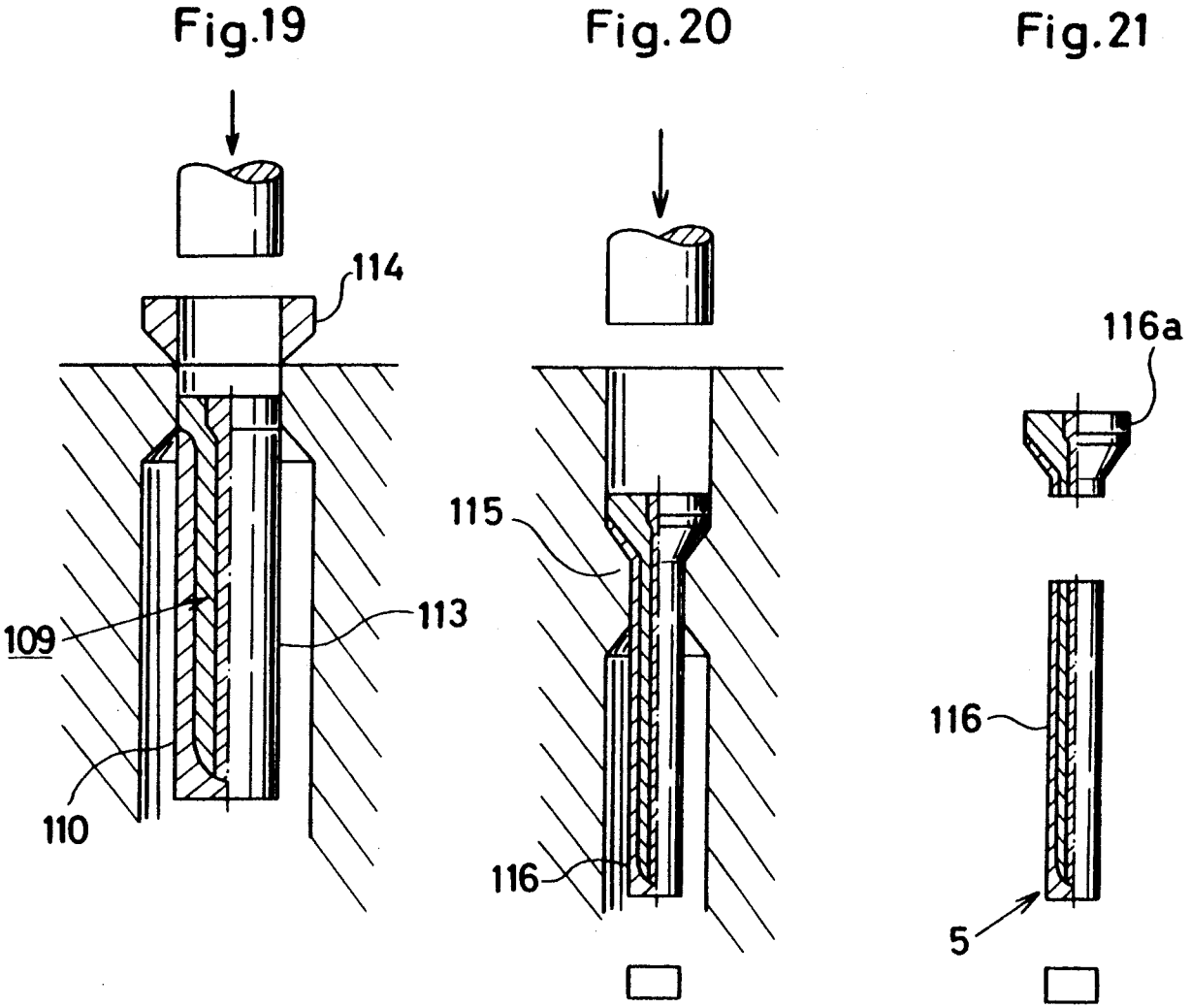

(iv) A flange head 114 provided with the elongated bar 113 during the extrusion process is removed from the elongated bar 113 as shown in FIG. 19.

(v) The elongated bar 113 is forced into a rectangular hole provided with a rectangular die 115 to extrude the elongated bar 113 so as to form a rectangular bar 116 rectangular in section as shown in FIG. 20.

(vi) A rear portion of the rectangular bar 116 so that a rear end 116*a* of the rectangular bar 116 is flush with that of the outer metall 7, the middle core 6 and the centermost core 8 as shown in FIG. 21. Then, the rectangular bar 116 is thermally anealed to form the outer electrode 5.

Figure 22:
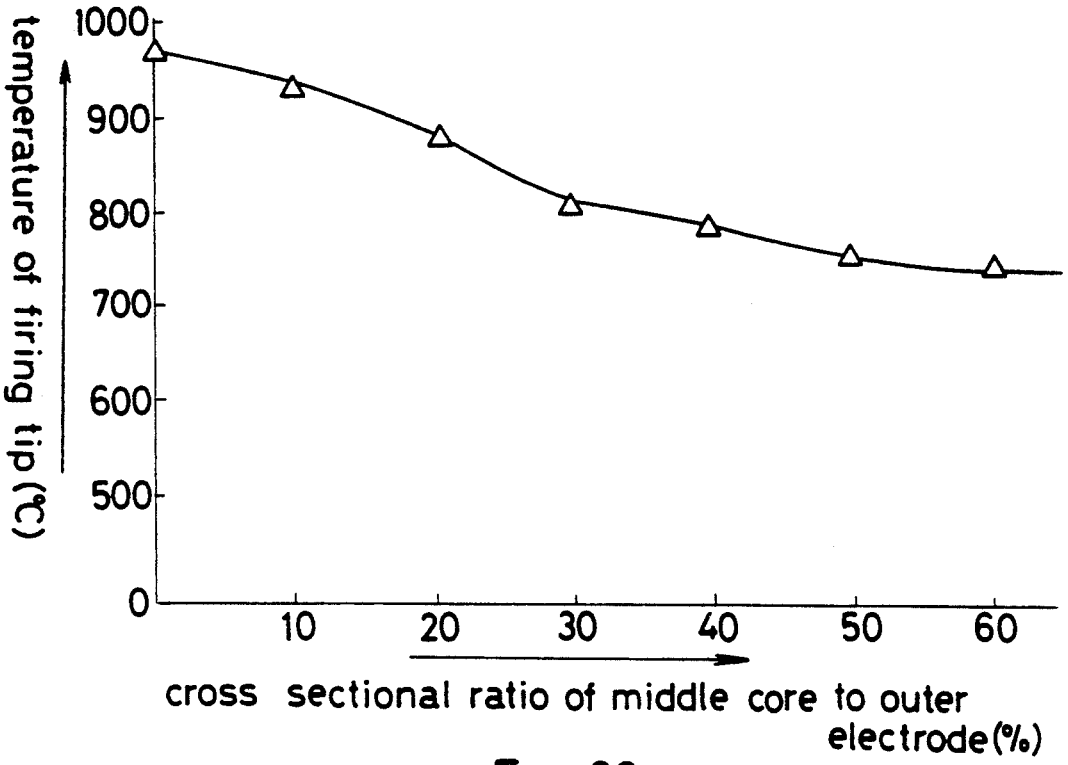
FIG. 22 is a graph similar to FIG. 12.

A first experiment is carried out to find how a cross sectional ratio of the middle core 6 to the outer electrode 5 has an influence on a heat-dissipating effect of the outer electrode 5. The result obtained after the first experiment is as shown in FIG. 22 which indicates that the sufficient heat-dissipating is insured by determining the cross sectional ratio to be 20% or more.

Figure 23:
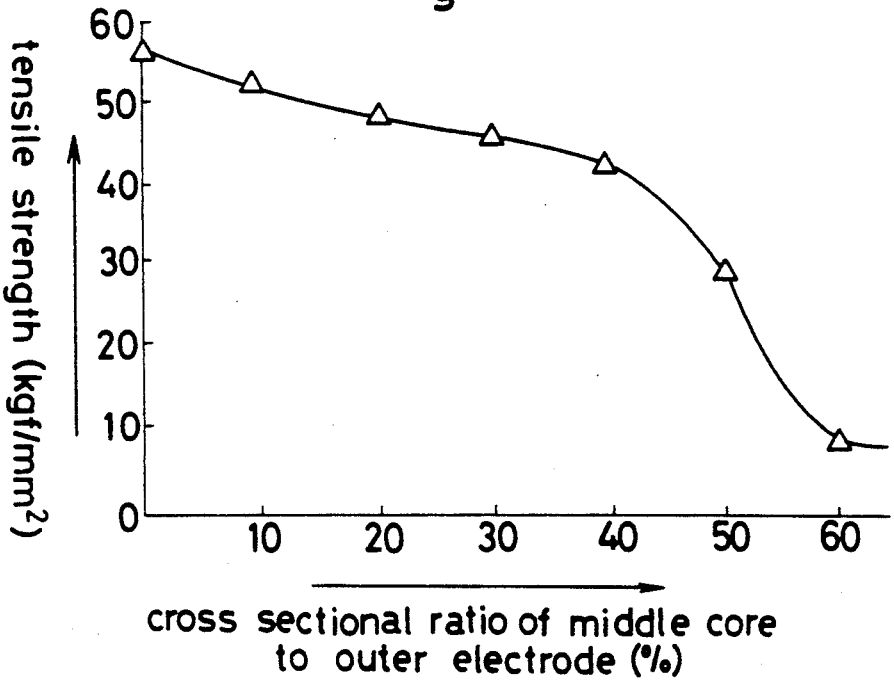
FIG. 23 is a graph similar to FIG. 13.

A second experiment is carried out to find how a cross sectional ratio of the middle core 6 to the outer electrode 5 has an influence on a tensile strength of the welding portion between the metallic shell 4 and the outer electrode 5. The result obtained after the second experiment is as shown in FIG. 23 which indicates that the sufficient tensile strength is insured by determining the cross sectional ratio to be 50% or less.

As apparent from the three experiments, the middle core 6 is located between the outer metal 7 and the centermost core 8, each of which has an identical coefficient of thermal expansion. This structure enables to protect the outer electrode 5 against unfavorable deformation when exposed to the combustion chamber (Ch) of the internal combustion engine.

Further, the cross sectional ratio of the middle core 6 to the outer electrode 5 is determined to be within the range from 20% to 50% so as to insure the heat-dissipating effect of the outer electrode 5 with physically sufficient strength of the welded portion maintained between the metallic shell 4 and the outer electrode 5.

Figure 24:
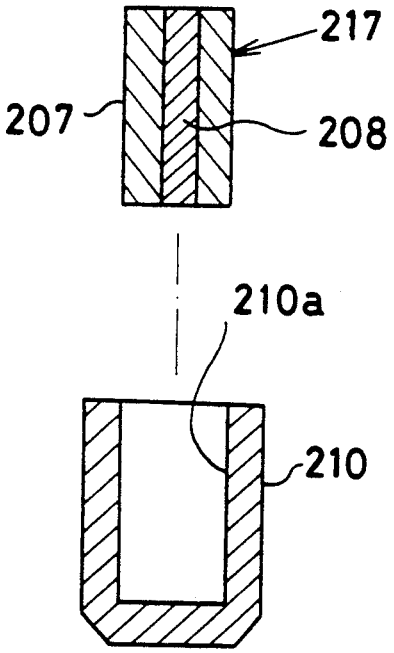
FIGS. 24 and 25 are schematic views of manufacturing processes of the outer electrode according to a modification form of the second embodiment of the invention.
Figure 25:
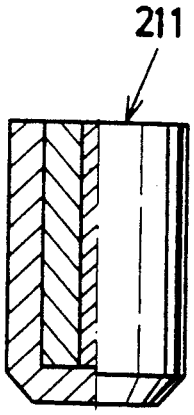

Referring to FIGS. 24 and 25 which shows a modification form the manufacturing method according to the second embodiment of the invention, a copper tube 207, which serves as the middle core 6, has no flange portion as opposed to the second embodiment of the invention. Into the copper tube 207, is a nickel extension strip 208 forced to provide a clad wire 217. Then, the clad wire 217 is forced into a hollow portion 210*a* of a nickel alloy cup 210 to form a composite body 211 as shown in FIG. 25. Processes subsequent to the formation of the composite body 211 is the same as those mentioned at the second embodiment of the invention in reference to FIGS. 18 through 21.

In this instance, the cup 210 may be made of copper, while the clad wire 217 made of pure nickel.

It is noted that a plurality of outer electrodes may be provided instead of a single outer electrode.

It is further noted that the outer electrode may be bent into a C-shaped configuration instead of L-shaped configuration.

It is appreciated that an outer electrode of straight type may be used, and the outer electrode may be slantwisely located to oppose to the periphery of the center electrode.

While the invention has been described with reference to the specific embodiments, it is understood that this description is not to be construed in a limitting sense in as much as various modifications and additions to the specific embodiments may be made by skilled artisan without departing the spirit and scope of the invention.

What is claimed is:

1. An outer electrode, a rear end of which is securely connected to a metallic shell of a spark plug by means of welding to form a spark gap between a front end of the outer electrode and a firing tip of a center electrode which is concentrically placed within the metallic shell through an insulator, the outer electrode comprising:

a middle core which is made of copper to have a heat-conductive property, the middle core being clad by a heat and spark-erosion resistant metal; and a centermost core clad by the middle core, the centermost core being made of a metal weld-intense to that of the metallic shell, and a rear end of the centermost core being welded to the metallic shell so as to reinforce a welding portion between the metallic shell and the outer electrode.

2. An outer electrode as recited in claim 1, wherein the rear end of the centermost core terminates at that of the middle core, while a front end of the centermost core terminates short of that of the middle core.

3. An outer electrode as recited in claim 1, wherein the centermost core has a thermal expansion substantially similar to that of the metal cladding the middle core, and has an axial length substantially similar to that of the middle core.

4. An outer electrode as recited in claim 3, wherein a cross sectional area of the middle core is determined to be within a range from 20% to 40% of that of the outer electrode.

5. An outer electrode as recited in claim 1, wherein the centermost core is made of pure nickel, nickel-based alloy or pure iron.

6. A method of manufacturing an outer electrode for a spark plug comprising the steps of:

forcing a centermost core into an upper recess provided with a metallic column which is made of copper to form a first body, a rear end of the centermost core terminating at that of the metallic column, while a front end of the centermost core terminates short of that of the metallic column;

forcing the first body into a cup-shaped metal until an upper end of the first body reaches to an upper end of the cup-shaped metal to form a second body;

forcing the second body into a circular hole provided with a die to extrude the second body so as to form an elongated bar;

removing an upper end of the elongated bar;

forcing the elongated bar into a rectangular hole provided with a rectangular die to extrude the elongated bar so as to form a rectangular bar;

cutting a rear portion of the rectangular bar so that a rear end of the rectangular bar is flush with that of the metal cladding the metallic column; and thermally annealing the rectangular bar;

a cross sectional area of the metallic column being within a range from 20% to 40% of that of the outer electrode.

7. An method of manufacturing an outer electrode for a spark plug as recited in claim 6, wherein the centermost core has an axial length substantially similar to that of the metallic column at the time of forcing the centermost core into the axial recess which is provided with the metallic column.

* * * * *